US006614008B2

(12) United States Patent
Tidrick

(10) Patent No.: US 6,614,008 B2
(45) Date of Patent: Sep. 2, 2003

(54) UNIVERSAL VOLTAGE FUSER HEATER LAMP

(75) Inventor: Robert C. Tidrick, Portland, OR (US)

(73) Assignee: Xerox Corporation, Stamford, CT (US)

( * ) Notice: Subject to any disclaimer, the term of this patent is extended or adjusted under 35 U.S.C. 154(b) by 111 days.

(21) Appl. No.: 10/014,451

(22) Filed: Dec. 14, 2001

(65) Prior Publication Data

US 2003/0111457 A1 Jun. 19, 2003

(51) Int. Cl.[7] ..... H05B 3/02
(52) U.S. Cl. ..... 219/483; 219/486
(58) Field of Search ..... 219/220, 240, 219/476, 477, 482, 483, 485, 486, 488, 489, 507, 508, 509; 250/495.1; 362/92, 95; 315/58, 362, 56, 71, 72, 67, 68; 313/1, 274, 316

(56) References Cited

U.S. PATENT DOCUMENTS

| | | | | |
|---|---|---|---|---|
| 1,716,645 A | | 6/1929 | Kuen | |
| 1,722,002 A | | 7/1929 | Kuen et al. | |
| 1,802,167 A | | 4/1931 | Blank | |
| 3,272,977 A | | 9/1966 | Holmes | |
| 3,443,144 A | | 5/1969 | Freese | |
| 3,791,710 A | | 2/1974 | Curtis | 316/17 |
| 4,442,374 A | | 4/1984 | Morris et al. | 313/316 |
| 4,488,082 A | | 12/1984 | Cummins | 313/318 |
| 4,598,342 A | | 7/1986 | English et al. | 362/213 |
| 4,621,220 A | | 11/1986 | Morris et al. | 313/318 |
| 4,626,735 A | | 12/1986 | Morris et al. | 313/275 |
| 4,710,676 A | | 12/1987 | Morris et al. | 313/579 |
| 5,053,806 A | | 10/1991 | Haigo et al. | 355/30 |
| 5,091,632 A | | 2/1992 | Hennecke et al. | 219/553 |
| 5,455,484 A | * | 10/1995 | Maya et al. | 315/58 |
| 5,493,379 A | | 2/1996 | Kuroda et al. | 355/290 |
| 5,922,227 A | * | 7/1999 | McMurtrie | 219/220 |

* cited by examiner

*Primary Examiner*—Tu Ba Hoang
(74) *Attorney, Agent, or Firm*—Philip T. Virga

(57) ABSTRACT

A universal voltage fuser heater lamp is described for use in either United States or European markets having different voltage standards. The fuser lamp comprises first and second filaments having equal resistance and a switching mechanism for connecting a power supply to the fuser lamp. The switching mechanism connects the first and second filaments in a parallel configuration when the voltage is 120 Volts and connects the first and second filaments in series when the voltage is 240 Volts from the power supply.

20 Claims, 5 Drawing Sheets

UNIVERSAL VOLTAGE FUSER HEATER LAMP

FIELD OF INVENTION

The present invention relates generally to tubular incandescent lamps, and pertains, more particularly, to such lamps as applied in photo-reproduction processes.

BACKGROUND OF THE INVENTION

A photocopy machine typically employs two different types of lamps, one being referred to as an exposure lamp and the other as a fusing lamp. The exposure lamp is purely for light emitting purposes during the exposure phase of operation. The fusing lamp on the other hand is primarily for heating purposes to "set" the toner employed in the photocopy machine. In accordance with the present invention, the principles thereof are applied primarily in connection with a fusing heater lamp, but may also be applied to other general heating purposes.

Fusing heater lamps are typically of single filament construction and have a length corresponding to the maximum size (length) of paper that is to be reproduced. More recently, fusing heater lamps utilize two filaments disposed and electrically connected in parallel within a quartz envelope in order to allow substantially higher operating wattage to be achieved by simultaneously energizing both filaments. The use of parallel filaments provides higher heat density per unit area of envelope wall. However, these types of fuser heater lamps do not provide for selective activation of the filaments to adjust for different voltage output requirements.

Photocopier's used in both the United States and Europe operate at two different voltage ranges, namely 120 and 240 volts respectively, but each require the same amount of energy in the fuser lamp for fixing the toner (i.e. fusing) onto the copy of the original document. In U.S. Pat. No. 4,710,676 to Morris et al, a dual length filament incandescent lamp is provided that allows for switching between two different levels of total lamp energy at a single voltage to adjust for different incremental wattage output requirements. The specification of Morris et al (U.S. Pat. No. 4,710,676) is hereby incorporated by reference.

What would be desirable is a single tubular incandescent lamp without modification that can run on two different voltage ranges for heating applications for universal that use different voltage standards.

SUMMARY OF THE INVENTION

It is, therefore, a primary object of this invention to enhance the tubular incandescent lamp art and particularly that art involving lamps having more than one filament.

It is another object of this invention to provide an improved incandescent lamp wherein the lamp is readily adapted for use in either United States or European markets having different voltage standards.

In accordance with one aspect of this invention, there is provided a fuser lamp comprising first and second filaments having equal resistance and a switching mechanism for connecting a power supply to the fuser lamp. The switching mechanism connects the first and second filaments in a parallel configuration when the voltage is 120 Volts and connects the first and second filaments in series when the voltage is 240 Volts from the power supply.

BRIEF DESCRIPTION OF THE DRAWINGS

The objects, features and advantages of the invention will become apparent upon consideration of the following detailed disclosure of the invention, especially when it is taken in conjunction with the accompanying drawings wherein.

DETAILED DESCRIPTION OF THE INVENTION

Figure 1:
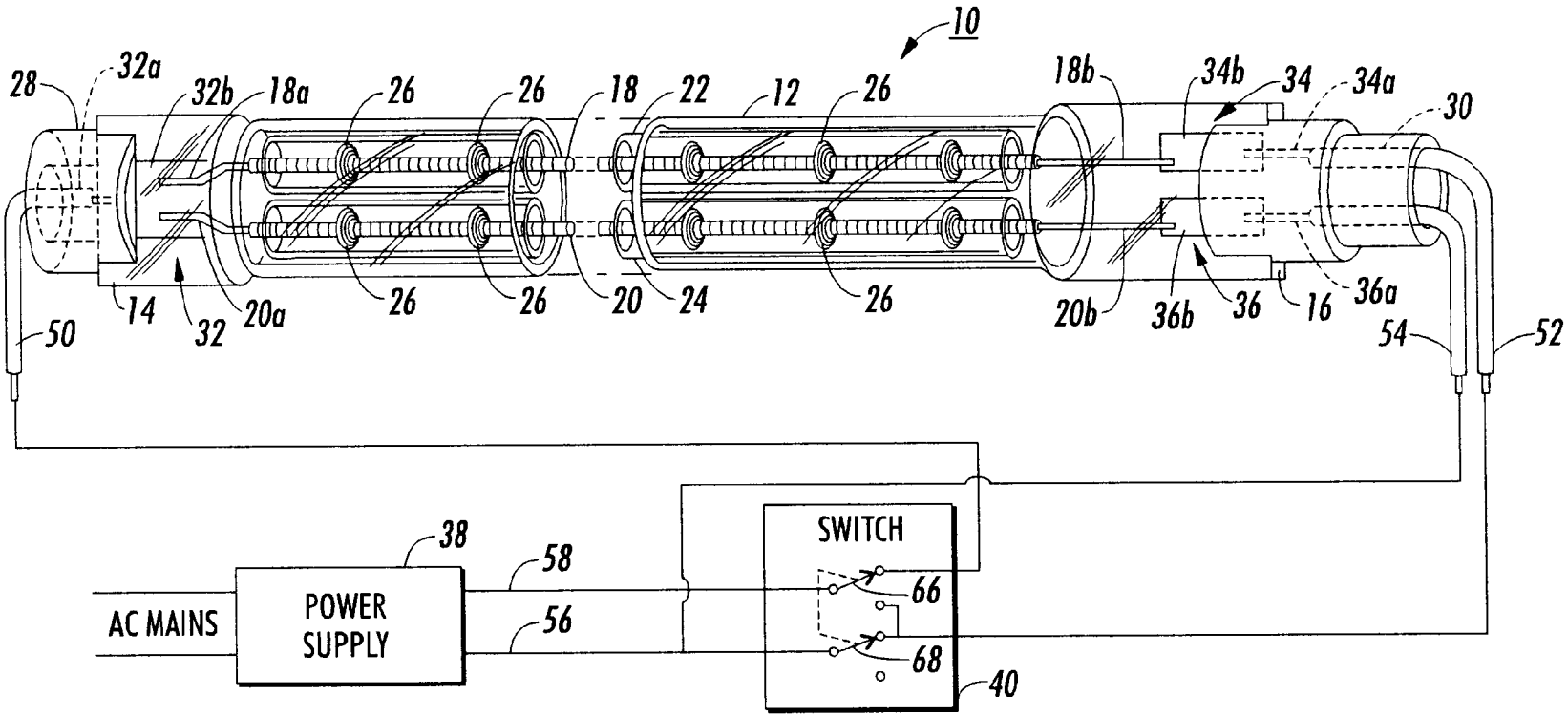
FIG. 1 is a side view, partly in section of a lamp illustrating the electrical switching control of the instant invention.

Referring to FIG. 1 there is shown a side view, partly in section of a fuser lamp 10 illustrating the electrical switching control or switching mechanism of the instant invention. In one embodiment of the invention, the electrical switching control or switch mechanism is a double-pole double-throw switch 40 defining a pair of first and second switches. As shown in FIG. 1, a power supply 38 delivers voltage to the fuser lamp 10 through the switch 40. It should be understood that the configuration and description of lamp 10 is for illustrative purposes only wherein any suitable fuser lamp may be used in association with the present invention. The lamp 10 comprises a tubular envelope 12 of vitreous material having first and second press-sealed end portions 14 and 16, respectively. Ends 14 and 16 are located at the opposed ends of envelope 12 and are formed by utilizing pressing operations and apparatus known in the art. Envelope 12 should preferably be made of a material having a high melting point, such as fused silica or quartz.

Lamp 10 is of the tungsten-halogen variety, therefore it has a fill gas mixture containing an inert gas and a halogen or halide. In the present invention, the lamps are filled at about one atmosphere of argon (as the inert gas) and have about 200 micrograms of bromine (specifically methyl bromide). Lamp 10 further includes a pair of tungsten filaments, 18 and 20, which are disposed within envelope 12 and extend longitudinally through the interior of the envelope. Filaments 18 and 20, as illustrated in FIG. 1, are electrically isolated from one another by isolating means, comprising two tubes, 22 and 24, that are disposed longitudinally within envelope 12. Filaments 18 and 20 extend longitudinally through tubes 22 and 24, respectively. Tubes 22 and 24 should be made of electrically insulative material that is transparent and has a high melting point, such as quartz. Tubes 22 and 24 extend the length of the interior of envelope 12 to about 1 millimeter (mm) from press sealed end portions 14 and 16. The filaments are also hermetically sealed within end portions 14 and 16.

Supporting filaments 18 and 20 at preselected points (about 25.4 mm apart) along the length thereof are a plurality of support members 26 (illustrated in FIG. 1), each comprising a coil element having one end wound about (and thus secured to) each of filaments 18 and 20 and the other end (of greater diameter) positively engaging the interior wall of tubes 22 and 24, respectively. In the embodiment illustrated in FIG. 1, filaments 18 and 20 possessed an overall length of about 350 mm. In addition, envelope 12 is a T-5 quartz tube having an outer diameter of about 15 mm with a thickness of about 1 mm. Tubes 22 and 24 are T-2 quartz tubes having outer diameters of about 6 mm and thicknesses of about 1 mm.

To facilitate positioning of lamp 10 within the photocopier designed for utilizing same, ceramic bases or end caps 28 and 30 are preferably used. Accordingly, it is only necessary in the respective photocopier to provide some means for accepting this component. Understandably, such a means can be of relatively simple design. Ceramic bases 28 and 30 are also preferably of substantially cylindrical configuration and include a slot therein designed for having the flattened press-sealed end portions, 14 and 16, inserted therein.

Filaments 18 and 20 are energized by means of applying a predetermined voltage across contact means located within the press sealed end portions of lamp 10. Specifically, first contact means 32 is associated with end portion 14, while second contact means 34 and third contact means 36 are associated with end portion 16. First contact means 32 is comprised of a first lead-in conductor 32*a,* which extends externally from and internally within end portion 14, and a foil portion 32*b* disposed within portion 14 and electrically coupled to both conductor 32*a* and to a first end 18*a* and 20*a* of filaments 18 and 20, respectively. Second contact means 34 is comprised of a second lead-in conductor 34*a,* which extends externally from and internally within end portion 16, and a foil portion 34*b* disposed within portion 16 and electrically coupled to both conductor 34*b* and to a second end 18*b* of filament 18. Finally, third contact means 36 is comprised of a third lead-in conductor 36*a,* extending externally from and internally within end portion 16, and a foil portion 36*b* disposed within end portion 16 and electrically coupled to both conductor 36*a* and to an unattached second end 20*b* of filament 20.

Referring once again to FIG. 1, the terminals 56 and 58 of power supply 38 are coupled to the input side of first and second switches 66 and 68 respectively, of the double-pole double-throw switch 40. Lead-in conductor 32 is coupled to a lead wire 50, which is in turn coupled to the output side of first switch 66. Lead-in conductor 34 is coupled to a lead wire 52, which is in turn coupled to the output side of switch 68 and lead-in conductor 36 is coupled to a lead wire 54, which is in turn coupled to the input side of switch 68. Leads 50, 52 and 54 may in one embodiment be stranded 16 AWG (AWG=American Wire Gauge) teflon insulated wire which is rated at 600 V and 200° C. Lead wires 50, 52 and 54, through switch 40 apply a voltage across filaments 18 and 20. In accordance with the present invention, fuser heater lamps such as lamp 10 are broken into two regions wherein each region is represented as a filament, each at 120 volts. When the fuser is operated at 120 volts, the regions are connected in parallel and when operated at 240 volts, they are connected in series.

Figure 2A:
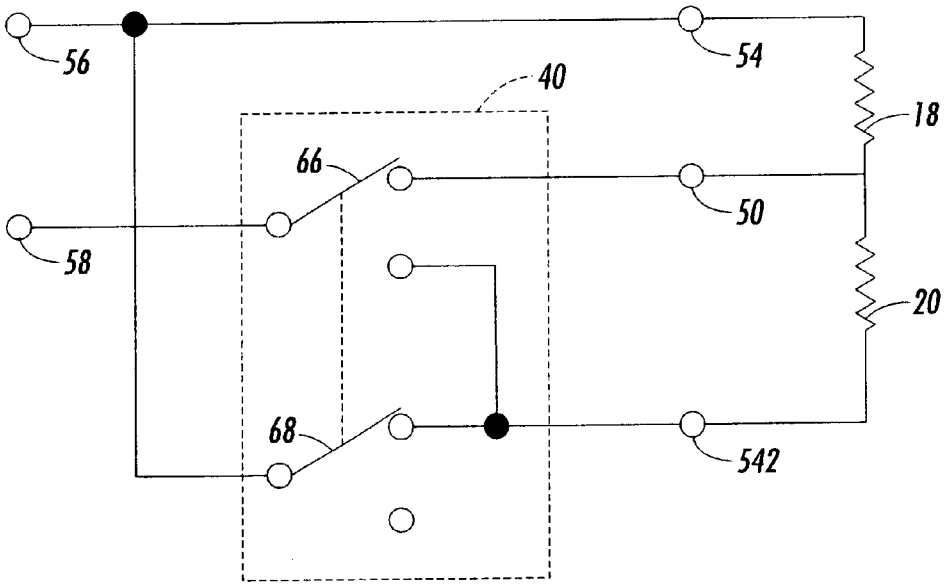
FIGS. 2A–2B is an electrical circuit schematic illustrating switch states of the instant invention.
Figure 2B:
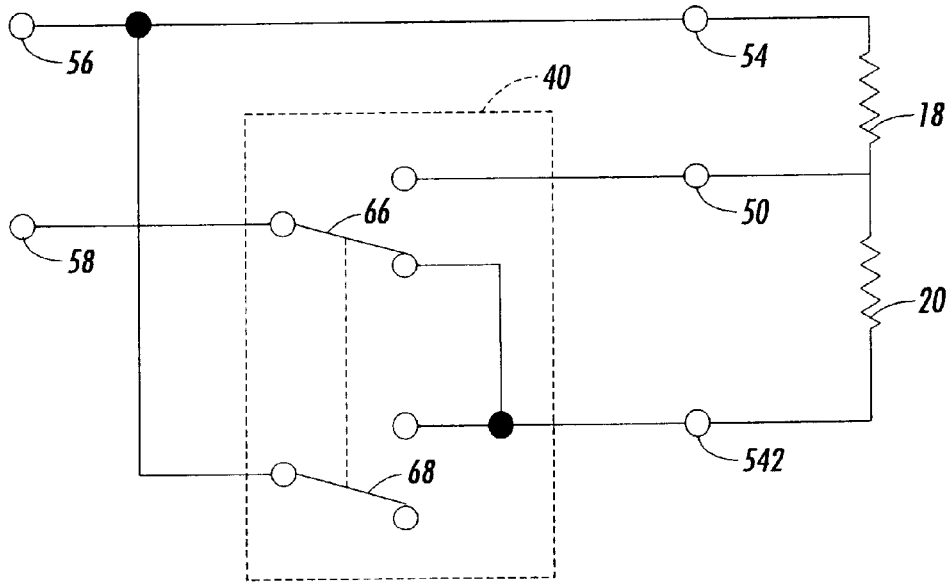

Referring now to FIGS. 2A–2B, there is shown electrical circuit schematics illustrating the two different switch states. FIG. 2A illustrates the parallel connection when the first and second switches 66 and 68 of the double-pole double-throw switch 40 are in the up position. In this state the lead wires 52 and 54 of filaments 18 and 20 are connected in parallel through terminal 56 when lead wire 50 is connected to terminal 58. FIG. 2B illustrates the series connection when the first and second switches 66 and 68 of the double-pole double-throw switch 40 are in the down position. In this state the lead wires 52 and 54 of filaments 18 and 20 are connected in series through terminals 56 and 58 when lead wire 50 is in an open state. The filaments 18 and 20 have the same value of resistance such that the fuser lamp 10 with the switching means in accordance with the present invention may be universally connected to power supplies in either the United States and European markets.

Turning once again to FIG. 1, the double-pole double-throw switch 40 is positioned such that filaments 18 and 20 are in series and therefore in the 240 Volt configuration. By way of example but not of limitation, for a fuser lamp 10 to operate at 1000 Watts and using Ohm's law the resistance per filament is calculated as follows:

$$R=E^2/P$$

where:

R=DC resistance in Ohms;

P=Power in Watts;

E=Voltage in Volts;

for a 1000 Watt fuser lamp operating in the United States at 120 Volts:

$$R_{120V}=120^2\text{Volts}/1000\text{ Watts}$$

$$R_{120V}=14.4\text{ Ohms;}$$

and for a 1000 Watt fuser lamp operating in Europe at 240 Volts:

$$R_{240V}=240^2\text{Volts}/1000\text{ Watts}$$

$$R_{240V}=57.6\text{ Ohms.}$$

Referring to FIG. 2A, for the 120 Volt arrangement the elements of resistance are arranged in parallel and are calculated using $R_{120V}=R_{120V}\times n$ where n is the number of elements. In this case the number of elements n or filaments is 2 such that $R_{120V}=14.4\text{ Ohms}\times 2=28.8\text{ Ohms}$. Referring to FIG. 2B, for the 240 Volt arrangement the elements of resistance are arranged in series and are calculated using $R_{240V}=R_{240V}/n$ where n is once again the number of elements (n=2) corresponding to filaments 18 and 20, respectively. In this case, $R_{240V}=57.6\text{ Ohms}/2=28.8\text{ Ohms}$. Therefore, by using filaments 18 and 20 each having a resistance of 28.8 Ohms a fuser lamp having a 1000 Watt output may be used in either the United States or Europe using the switching means in accordance with the present invention. As seen by the example, the resistances of a two-filament fuser lamp must be equal in order to switch between two different voltage standards.

Figure 3A:
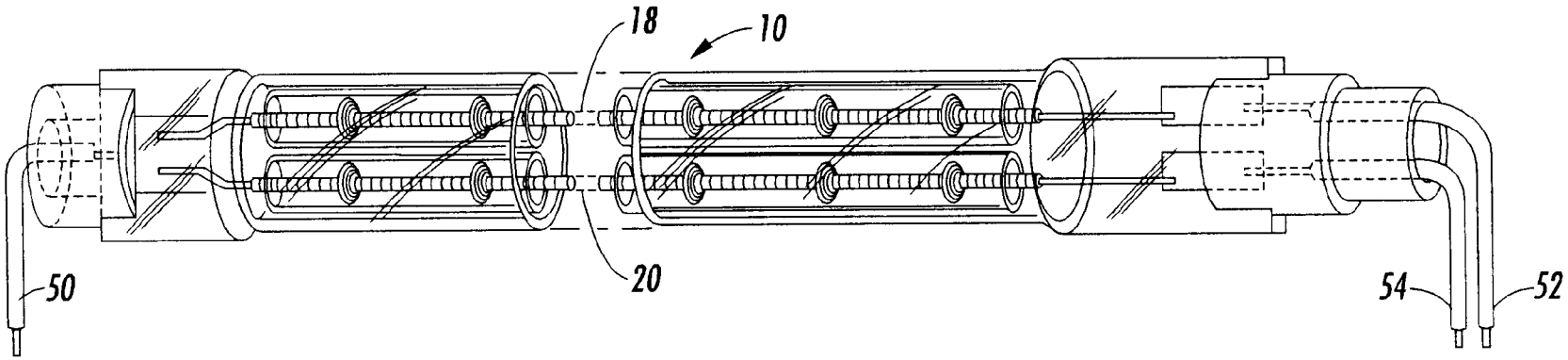
FIGS. 3A–3C are side views, partly in section, illustrating different lamp configuration embodiments for use with the electrical switching control of the instant invention.
Figure 3B:
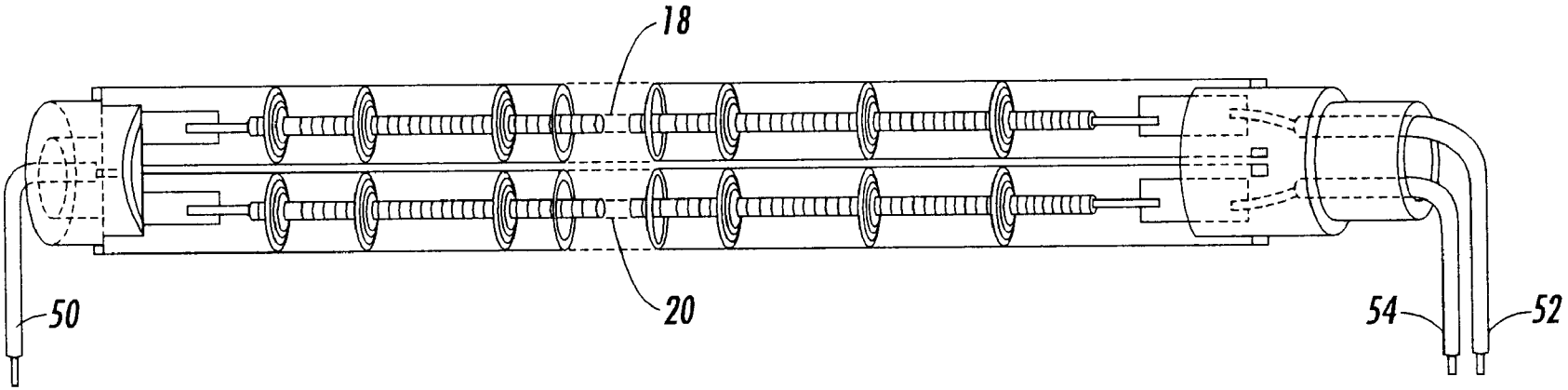
Figure 3C:
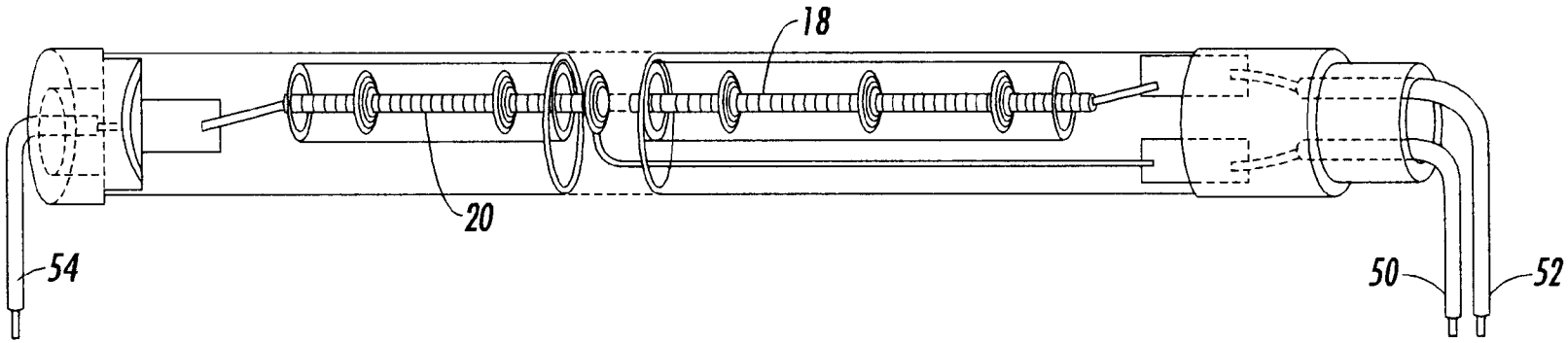

FIGS. 3A–3C are side views, partly in section, illustrating different lamp configuration embodiments for use with the electrical switching control of the instant invention. FIG. 3A illustrates a dual envelope lamp as described above. FIG. 3B illustrates a single envelope lamp wherein FIG. 3C is a single envelope lamp having a single center tapped filament. All the lamps of FIGS. 3A–3C are similar with respect to filament lengths and wattages, fill gas mixture, overall lamp length, lead wire connections and lamp-circuit connection with each having lead wires 50, 52 and 54 for use with the present invention. Additionally, although not shown any switching means may be used in lieu of a double-pole double-throw switch, such as an electronic switch that attains the desired effect of switching the filaments to a series or parallel arrangement.

While there have been shown and described what are at present considered embodiments of the invention, it will be obvious to those skilled in the art that various changes and modifications may be made therein without departing from the scope of the invention as defined by the appended claims.

What is claimed is:

1. A voltage fuser heater lamp comprising:

a power supply for delivering voltage;

a fuser lamp having first and second filaments; and a switching mechanism for connecting the power supply to the fuser lamp wherein the switching mechanism connects the first and second filaments in a series configuration in one state and connects the first and second filaments in parallel configuration in another state depending on the voltage from the power supply.

2. The voltage fuser heater lamp of claim 1, wherein the first and second filaments of the fuser lamp have equal resistance.

3. The voltage fuser heater lamp of claim 1, wherein the switching mechanism is a double-pole double-throw switch.

4. The voltage fuser heater lamp of claim 1, wherein the switching mechanism is an electronic switch.

5. The voltage fuser heater lamp of claim 1, wherein the fuser lamp is a dual envelope configuration.

6. The voltage fuser heater lamp of claim 1, wherein the fuser lamp is a single envelope configuration.

7. The voltage fuser heater lamp of claim 1, wherein the fuser lamp is a single envelope with center taped filament configuration.

8. The voltage fuser heater lamp of claim 1, wherein the power supply delivers 120 Volts and the switch mechanism connects the first and second filaments in parallel.

9. The voltage fuser heater lamp of claim 1, wherein the power supply delivers 240 Volts and the switch mechanism connects the first and second elements in series.

10. A voltage fuser heater lamp comprising:

a power supply for delivering voltage;

a fuser lamp having first and second filaments wherein the first and second elements have equal resistance; and a switching mechanism for connecting the power supply to the fuser lamp wherein the switching mechanism connects the first and second filaments in a series configuration in one state and connects the first and second filaments in a parallel configuration in another state depending on the voltage from the power supply.

11. The voltage fuser heater lamp of claim 10, wherein the switching mechanism is a double-pole double-throw switch.

12. The voltage fuser heater lamp of claim 10, wherein the switching mechanism is an electronic switch.

13. The voltage fuser heater lamp of claim 10, wherein the fuser lamp is a dual envelope configuration.

14. The voltage fuser heater lamp of claim 10, wherein the fuser lamp is a single envelope configuration.

15. The voltage fuser heater lamp of claim 10, wherein the fuser lamp is a single envelope with center taped filament configuration.

16. The voltage fuser heater lamp of claim 10, wherein the power supply delivers 120 Volts and the switch mechanism connects the first and second filaments in parallel.

17. The voltage fuser heater lamp of claim 10, wherein the power supply delivers 240 Volts and the switch mechanism connects the first and second elements in series.

18. A voltage fuser heater lamp comprising:

a power supply for delivering voltage;

a fuser lamp having first and second filaments wherein the first and second elements have equal resistance; and a switching mechanism for connecting the power supply to the fuser lamp wherein the switching mechanism connects the first and second filaments in a parallel configuration when the voltage is 120 Volts and connects the first and second filaments in series when the voltage is 240 Volts from the power supply.

19. The voltage fuser heater lamp of claim 18, wherein the switching mechanism is a double-pole double-throw switch.

20. The voltage fuser heater lamp of claim 18, wherein the switching mechanism is an electronic switch.

* * * * *